US007798495B1

(12) United States Patent
Jolicoeur

(10) Patent No.: US 7,798,495 B1
(45) Date of Patent: Sep. 21, 2010

(54) ELECTRONIC TABLE TOP BOARD GAME

(76) Inventor: Pierre Jolicoeur, 114 Glen Wood Ave., Bridge Port, CT (US) 06610

( * ) Notice: Subject to any disclaimer, the term of this patent is extended or adjusted under 35 U.S.C. 154(b) by 867 days.

(21) Appl. No.: 11/714,753

(22) Filed: Mar. 7, 2007

Related U.S. Application Data

(60) Provisional application No. 60/781,195, filed on Mar. 13, 2006.

(51) Int. Cl.
*A63F 9/24* (2006.01)

(52) U.S. Cl. ..... 273/237; 273/242; 273/441

(58) Field of Classification Search ..... None
See application file for complete search history.

(56) References Cited

U.S. PATENT DOCUMENTS 3,856,303 A 12/1974 Paynr, Jr. et al.
5,297,792 A 3/1994 Friedman
5,433,443 A 7/1995 ples

*Primary Examiner*—M. Sager

(57) ABSTRACT

A game board has grooves aligned parallel to X and Y axes that define travel paths along pre-determined directions covering a surface area thereof. Notches are formed along end regions oppositely spaced from each other along an outer periphery of the board. Controllers are coupled to the board, and game pieces are positional along the grooves. Target zones are anchored to the board and spaced along the grooves. Projectiles associated with the game pieces are stored within the notches. A mechanism displaces each of the game pieces along the grooves based upon a user input through an associated controller, and maintains contact with a bottom surface of the grooves. A mechanism rotates one arm of each of the game pieces such that each player tosses one of the projectiles along a travel path terminating at one of the target zones.

18 Claims, 3 Drawing Sheets

ELECTRONIC TABLE TOP BOARD GAME

CROSS REFERENCE TO RELATED APPLICATIONS

This application claims the benefit of U.S. Provisional Application No. 60/781,195, filed Mar. 13, 2006, of which the entire disclosures are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to board games and, more particularly, to an electronic table top board game for providing user enjoyment.

2. Prior Art

For centuries, games have been a favorite pastime of adults as well as children. In fact, the earliest form of the familiar checkers can be traced to the Egyptians as early as 600 B.C. Traditional board, card and trivia games continue to flourish, despite the foreboding in recent years that these would suffer in popularity from the onslaught of computer, video and handheld forms of play. Culture watchers further stipulate that in these especially trying times, with terrorism looming and an uncertain economy, games encourage relaxed, comfortable social interchange. Proving that nothing can equate the interaction of people in a common recreational pursuit, these tried-and-true diversions are certain to be around for a long time to come. Having recognized the potential for a fun and challenging new game, the present invention was developed.

One prior art example shows a parlor type indoor basketball game including a simulated basketball court and a plurality of maneuverable ball propelling mechanisms including playing pieces activated by push rods slidably disposed under the court and adapted to be operated at each end of the court by opposing players for bringing the ball toward a basket at one end of the court or the other. An additional mechanism in the form of an inclined ramp is employed which in conjunction with the ball propelling mechanism serves to raise the ball upwardly from the floor of the court in the general direction of the basket for a possible score. Unfortunately, this prior art example does not provide the unique elements of unicycle movement combined with an independently operable means of propelling a projectile toward a target.

Another prior art example shows a sport simulation game having a two dimensional playing field with a number of defensive players attached thereto and moveable in at least a widthwise direction. The offensive player is moveable in both a lengthwise and widthwise direction and is controlled by a hand control. The offensive player may carry a ball and the object is for the offensive player to move lengthwise over the playing field while avoiding engagement with any of the defensive players. One or two players may play the game. With two players, one player would use a hand control to control movement of the defensive player. With one player, the defensive players would be set to automatically move either independently of or dependent upon the lengthwise movement of the offensive player. Unfortunately, this prior art example provides a limited amount of movement and interaction of the game pieces and also does not provide the unique elements of unicycle movement.

Accordingly, a need remains for an electronic table top board game in order to overcome the above-noted shortcomings. The present invention satisfies such a need by providing a device that is convenient and easy to use, is lightweight yet durable in design, and provides hours of user enjoyment. Such a device is a three-dimensional, enhanced simulation of a unique, sports-like competition, combining the benefits of virtual and live action to increase the thrilling realism that is inherent in such spirited play. The device encourages positive social and family interaction through good-natured competition. The present invention can be easily set up on a recreation room floor or outside on a patio. With simple to follow instructions and a multitude of fun and thrilling plays, the device can be enjoyed by children as well as adults.

BRIEF SUMMARY OF THE INVENTION

In view of the foregoing background, it is therefore an object of the present invention to provide a device for an electronic table top board game. These and other objects, features, and advantages of the invention are provided by an electronic table top board game for providing user enjoyment.

The device includes a game board that has a plurality of grooves aligned parallel to X and Y axes respectively. Such grooves effectively define travel paths along pre-determined directions covering a major surface area of the game board. Such a game board further has a plurality of linearly shaped notches formed along end regions oppositely spaced from each other and advantageously located along an outer periphery of the game board respectively.

The device further includes a plurality of controls operably coupled to the game board, and a plurality of mobile game pieces selectively positional along the grooves. A plurality of target zones is manually and removably anchored to the game board and spaced along the grooves. A plurality of projectiles are associated with each of the game pieces and are conveniently stored within the notches. Such game pieces further include a plurality of conductive leads in electrical communication with the grooves, and first and second switches directly coupled to the leads and the processor (herein described below) respectively. First and second output signals effectively instruct the first and second switches to independently toggle between open and closed positions such that each of the game pieces simultaneously receives the first and second output signals from each of the controllers based upon the user input.

The device further includes a mechanism for independently displacing each of the game pieces along the grooves based upon a user input triggered through an associated one of the controllers. Such a game piece displacing mechanism effectively maintains direct contact with a bottom surface of the grooves during playing conditions. The game piece displacing mechanism conveniently includes a processor, and a memory electrically coupled thereto. Such a memory includes software instructions that effectively cause each of the game pieces to be responsive to the user input. Such software instructions include and execute a control logic algorithm that includes the steps of determining whether a first one of the controls has been engaged by an associated one of the players, determining a direction in which the first control has been adapted, determining a magnitude in which the first control has been adapted, and generating a first output signal for effectively instructing the game pieces to travel along the grooves based upon the determined direction and magnitude of the first control adaptation.

The game piece displacing mechanism further includes a motor housed within each of the game pieces, and a drive shaft directly mated to the motor and extending downwardly wherein the drive shaft advantageously terminates subjacent to an associated wheel of each of the game pieces such that the drive shaft is in operating and direct communication with the conductive leads while the wheel remains effectively spaced above the grooves. Such a motor rotates the drive shaft about a vertically registered fulcrum axis effectively defined along a longitudinal length of the drive shaft such that the conductive leads are advantageously caused to rotate in sync and travel along orthogonal directions effectively defined along the grooves.

The device further includes a mechanism for pivotally rotating one arm of each of the game pieces such that each player effectively tosses one of the projectiles along a travel path advantageously terminating at one of the target zones while a remaining portion of the game piece remains conveniently engaged with the game board. Such an arm pivoting mechanism includes software instructions residing on the memory that effectively cause the arm to pivot along a first arcuate path and simultaneously rotate about a fulcrum axis defined along the arcuate path. Such software instructions include and execute a control logic algorithm that includes the steps of determining whether a second one of the controls has been engaged by an associated one of the players, determining a direction in which the second control has been adapted, determining a radius in which the second control has been adapted, and generating a second output signal for instructing the arm to pivot along an arcuate path and rotate about the fulcrum axis based upon the direction and magnitude of the second control adaptation.

The arm pivoting mechanism further includes first and second beveled gears directly connected to each other. Such a first beveled gear is directly anchored to a top end of the drive shaft and further is rotatable in sync therewith. A driven motor is electrically coupled to one of the first and second switches. A rectilinear shaft advantageously protrudes outwardly from each of the game pieces and has a basket directly attached to a distal end thereof. Such a basket conveniently holds one of the projectiles therein during operating conditions. An arcuately shaped pivot arm has opposed ends pivotally anchored to the driven motor and a proximal end of the shaft respectively. Such a pivot arm advantageously rotates along a second arcuate path that has a radius smaller than a radius of the first arcuate path such that the rectilinear arm effectively rotates in sync therewith. The first beveled gear is driven by the drive shaft along a horizontal plane and thereby effectively causes the second beveled gear to rotate along a vertical plane in such a manner that the rectilinear arm simultaneously rotates and pivots based upon the user input.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
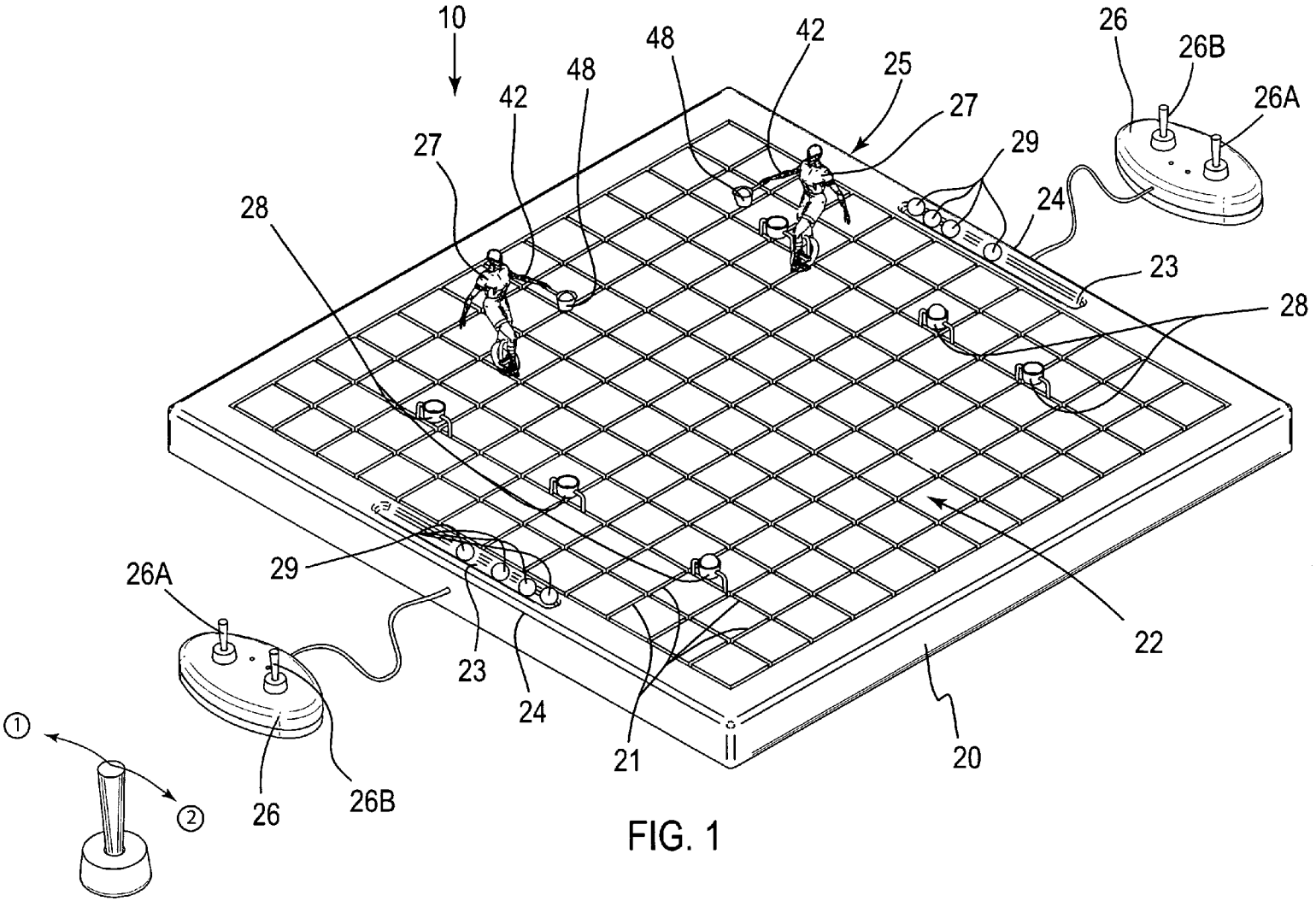
FIG. 1 is a perspective view of an electronic table top board game, in accordance with the present invention.
Figure 2:
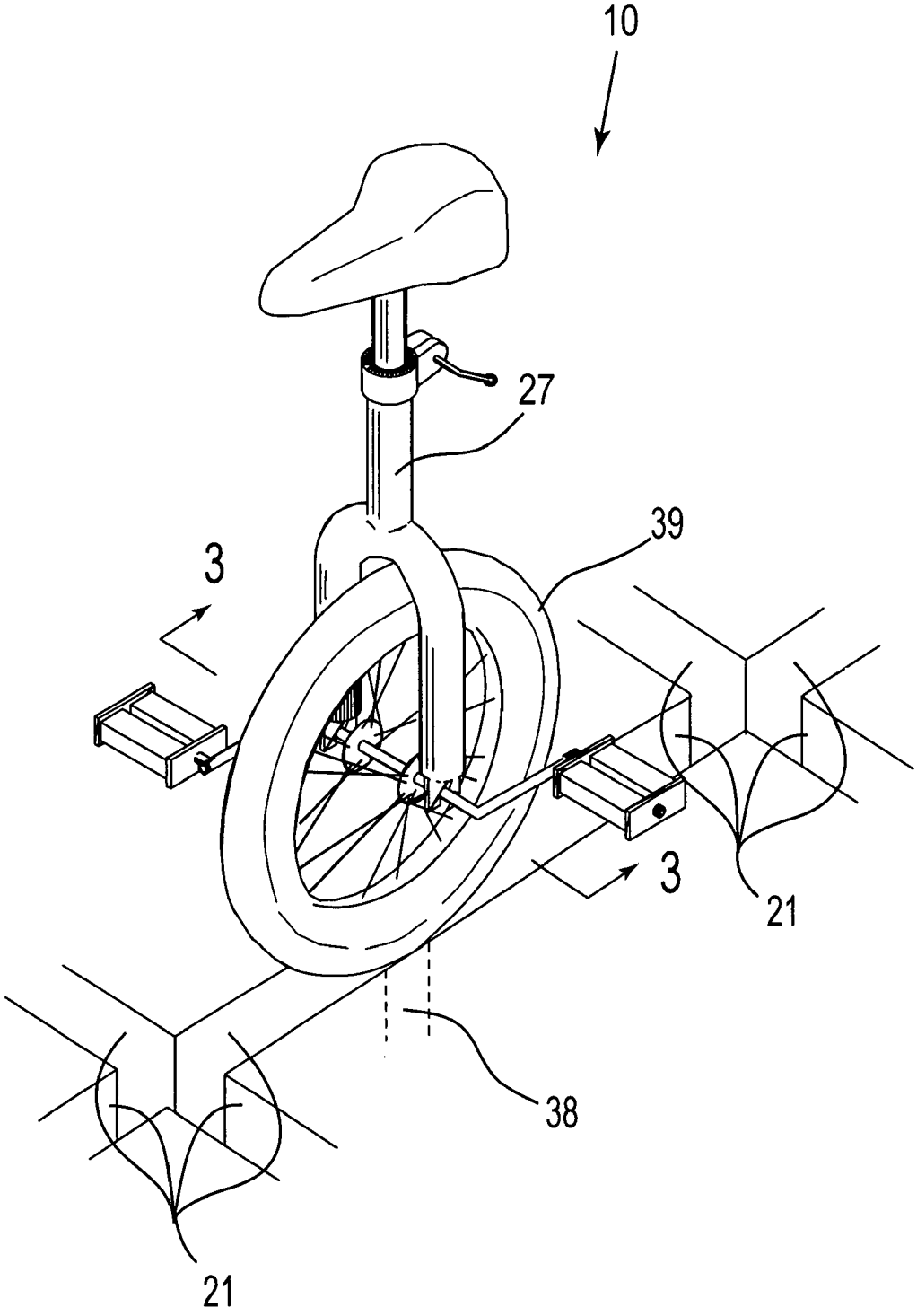
FIG. 2 is a perspective view of a mobile game piece shown in FIG. 1.
Figure 3:
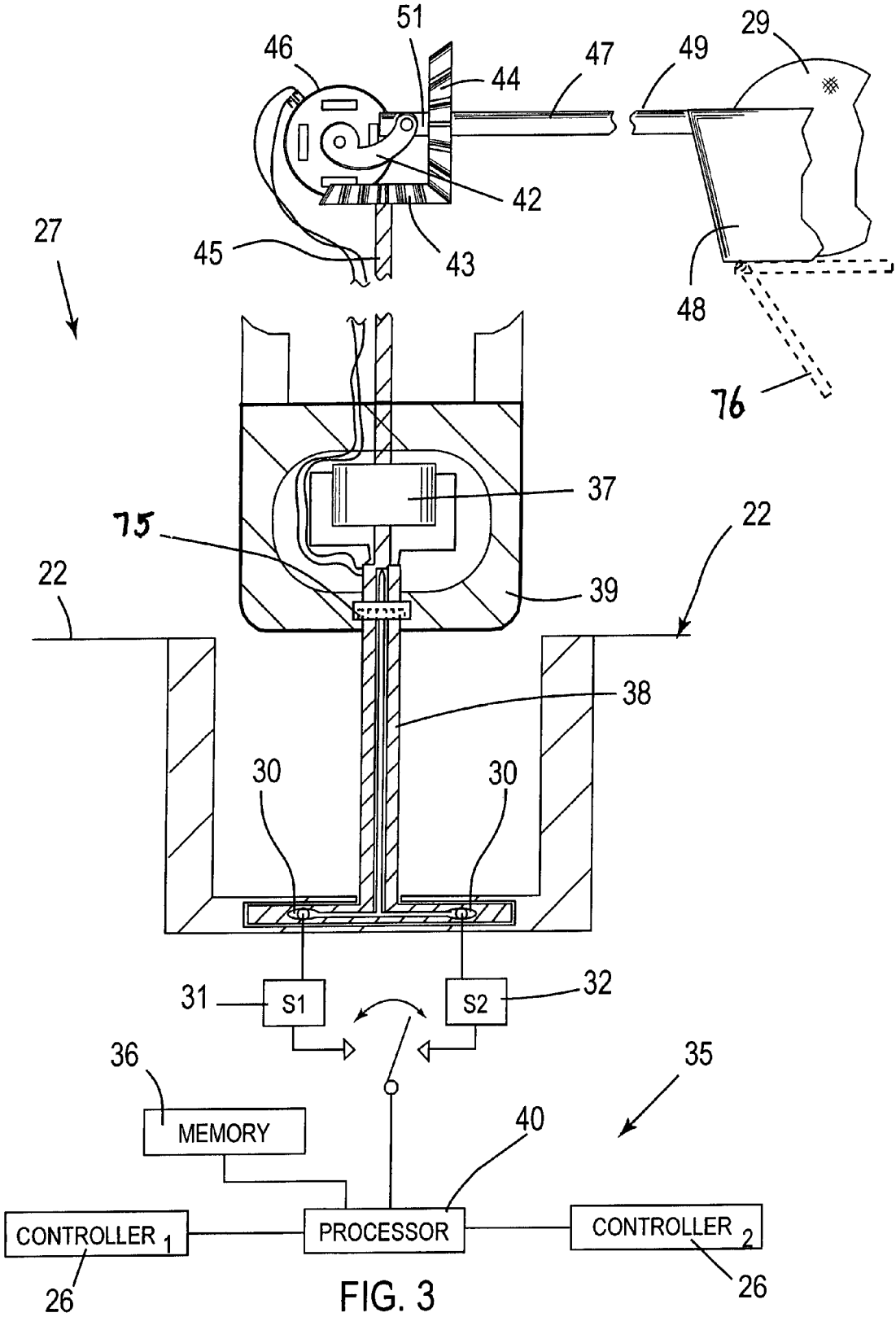
FIG. 3 is a cross sectional view of the game piece shown in FIG. 2, taken along line 3-3, and a schematic block diagram of the game piece displacing mechanism.

The device of this invention is referred to generally in FIGS. 1-3 by the reference numeral 10 and is intended to provide an electronic table top board game. It should be understood that the device 10 may be used to provide enjoyment to many different types of users and should not be limited to providing enjoyment only to those types of users described herein.

Referring initially to FIG. 1, the device 10 includes a game board 20 that has a plurality of grooves 21 aligned parallel to X and Y axes respectively. Such grooves 21 define travel paths along pre-determined directions covering a major surface area 22 of the game board 20. Such a game board 20 further has a plurality of linearly shaped notches 23 formed along end regions 24 oppositely spaced from each other and advantageously located along an outer periphery 25 of the game board 20 respectively. Of course, such grooves 21 and notches 23 can be formed in a variety of shapes and sizes, as is obvious to a person of ordinary skill in the art.

Referring to FIGS. 1, 2 and 3, the device 10 further includes a plurality of controls 26 operably coupled to the game board 20, and a plurality of mobile game pieces 27 selectively positional along the grooves 21. Of course, such game pieces 27 can be produced in a variety of shapes and sizes, as is obvious to a person of ordinary skill in the art. A plurality of target zones 28 is manually and removably anchored to the game board 20 and spaced along the grooves 21. A plurality of projectiles 29 are associated with each of the game pieces 27 and are conveniently stored within the notches 23. Of course, such projectiles 29 can be produced in a variety of shapes and sizes, as is obvious to a person of ordinary skill in the art. Such game pieces 27 further include a plurality of conductive leads 30 in electrical communication with the grooves 21, and first 31 and second 32 switches directly coupled, without the use of intervening elements, to the leads 30 and the processor 40 (herein described below) respectively. First and second output signals instruct the first and second switches 31, 32 to independently toggle between open and closed positions, which are essential such that each of the game pieces 27 simultaneously receives the first and second output signals from each of the controllers 26 based upon the user input.

Referring to FIG. 3, the device 10 further includes a mechanism 35 for independently displacing each of the game pieces 27 along the grooves 21 based upon a user input triggered through an associated one of the controllers 26. Such a game piece displacing mechanism 35 maintains direct contact with a bottom surface of the grooves 21 during playing conditions. The game piece displacing mechanism 35 includes a processor 40, and a memory 36 electrically coupled thereto. Such a memory 36 includes software instructions that cause each of the game pieces 27 to be responsive to the user input. Such software instructions include and execute a control logic algorithm that includes the steps of determining whether a first one 26A of the controls 26 has been engaged by an associated one of the players, determining a direction in which the first control 26A has been adapted, determining a magnitude in which the first control 26A has been adapted, and generating a first output signal for instructing the game pieces 27 to travel along the grooves 21 based upon the determined direction and magnitude of the first control 26A adaptation.

In order to, communicate a full range of motion to the computer, the controls 26 measure theirs stick's position on two axes—the X axis (left to right), and the Y axis (up and down). Just as in basic geometry, the X-Y coordinates pinpoint the stick's position exactly. In the present invention, corresponding handles of each control 26 move a narrow rod (not shown) that sits in two rotatable, slotted shafts (not shown). Tilting the stick forward and backward pivots the Y-axis shaft from side to side. Tilting it left to right pivots the X-axis shaft. When the stick is moved diagonally, it pivots both shafts. Several springs (not shown) center the stick when it is let go of. To determine the location of the stick, the controls simply monitor the position of each shaft. Conventional analog controls perform such functions with two potentiometers.

Referring to FIGS. 2 and 3, the game piece displacing mechanism 35 further includes a motor 37 housed within each of the game pieces 27, and a drive shaft 38 directly mated to the motor 37, without the use of intervening elements. Such a drive shaft 38 extends downwardly and terminates subjacent to an associated wheel 39 of each of the game pieces 27, which is critical such that the drive shaft 38 is in operating and direct communication with the conductive leads 30, without the use of intervening elements while the wheel 39 remains spaced above the grooves 21. Such a motor 37 rotates the drive shaft 38 about a vertically registered fulcrum axis defined along a longitudinal length of the drive shaft 38, which is crucial such that the conductive leads 30 are caused to rotate in sync and travel along orthogonal directions defined along the grooves 21.

Referring to FIGS. 1 and 3, the device 10 further includes a mechanism 41 for pivotally rotating one arm 42 (herein described below) of each of the game pieces 27, which is vital such that each player tosses one of the projectiles 29 along a travel path advantageously terminating at one of the target zones 28 while a remaining portion of the game piece 27 remains engaged with the game board 20. Such an arm pivoting mechanism 41 includes software instructions residing on the memory that cause the arm 42 to pivot along a first arcuate path and simultaneously rotate about a fulcrum axis defined along the arcuate path.

Such software instructions include and execute a control logic algorithm that includes the steps of determining whether a second one 26B of the controls 26 has been engaged by an associated one of the players, determining a direction in which the second control 26B has been adapted, determining a radius in which the second control 26B has been adapted, and generating a second output signal for instructing the arm 42 to pivot along an arcuate path and rotate about the fulcrum axis based upon the direction and magnitude of the second control 26B adaptation.

Again referring to FIG. 3, the arm pivoting mechanism 41 further includes first 43 and second 44 beveled gears directly connected to each other, without the use of intervening elements. Such a first beveled gear 43 is directly anchored to a top end 45 of the drive shaft 38, without the use of intervening elements, and further is rotatable in sync therewith. A driven motor 46 is electrically coupled to one of the first and second switches 31, 32. A rectilinear shaft 47 advantageously protrudes outwardly from each of the game pieces 27 and has a basket 48 directly attached to a distal end 49 thereof, without the use of intervening elements. Such a basket 48 holds one of the projectiles 29 therein during operating conditions. Of course, such a basket 48 can be produced in a variety of shapes and sizes, as is obvious to a person of ordinary skill in the art.

Yet again referring to FIG. 3, an arcuately shaped pivot arm 42 has opposed ends pivotally anchored to the driven motor 46 and a proximal end 51 of the shaft 47 respectively. Such a pivot arm 42 advantageously rotates along a second arcuate path that has a radius smaller than a radius of the first arcuate path, which is important such that the pivot arm 42 rotates in sync therewith. The first beveled gear 43 is driven by the drive shaft 47 along a horizontal plane and thereby causes the second beveled gear 44 to rotate along a vertical plane, which is essential such that the pivot arm 42 simultaneously rotates and pivots based upon the user input.

The simultaneous association of the game piece displacing mechanism and the arm pivoting mechanism provides the unexpected benefit of allowing a user to move the game piece while simultaneously operating the pivoting arm by manipulating one controller, thereby overcoming prior art shortcomings.

In operation, the present invention is a three-dimensional, electronic tabletop board game that includes a surface board configured with rail-unicycle tracks, motorized unicycles that serve as playing pieces, a set of hand-baskets, a set of balls and cup goals, and two electronic controllers (as explained hereinabove). Ideal for children as well as adults, the present invention is for players aged 6 and older.

In a preferred embodiment, the surface board is rectangular in shape and measures approximately thirty inches in length, twenty-four inches in width, and five inches in depth, as an example. The rail-unicycle tracks that make up the surface board intersect in square formation to facilitate a vast number of directions and turns that can be taken by players as they navigate their unicycles along the board. Positioned at opposite sides of the board, the unicycle-riding figures that represent the players each carry a hand-basket that is used offensively or defensively during the play.

At each player's side of the board there is a Score Base Line which is the second horizontal track line. The Score Base Line enhances the action by making the players think ahead with every play. It also forces the defending player to plan his move so his opponents will run out of time before they are able to maneuver into scoring position, while at the same time using his own speed strategies to pass the Score Base Line and score. The handheld controls are used to manipulate the unicycles forward, backward, left, or right. When a player moves the analog stick (control), the figure on the cycle is "pedaling" as the unicycle's rail wheel spins and rolls along the track.

The provided balls and cups represent the object of the game, which is to proceed through the track lines and drop off the balls into the opponent's cup to score. This goal is achieved via the hand-operated controllers provided with device. These controllers resemble the joystick/button assemblies typical to video gaming systems and are configured to set the skill level of the game: beginner, professional, or specialist. There are two buttons at the top of each control which the players operate with their thumbs when dropping balls into the goal cup or into the hand-basket while passing balls to their teammates. The right button is used to drop balls, and the left button is used to raise the hand basket up or down. However, when players activate the left button, they must use their thumbs to press and hold onto it while moving the joystick forward to lower the hand-basket or backward to raise it up. In addition, a timing mechanism is also incorporated. The ball scored by a player is placed into the opponent's balls storage. To take a ball out of the goal cup, players must flip the cup over.

To start a game, players must select the skill level at which they wish to play. The chosen level, in turn, determines the number of cups used in the game: three cups for beginner, two cups for professional, and one cup for the specialist level. Next, the timer is set for a player's turn. When the timer begins, the offensive player unicyclist proceeds along the track (holding one hand-basket with one ball in it) toward the opponent's cup, while his other unicyclist creates space and gets into a good position on the board for a ball pass.

The defending player (who plays without a ball) uses the hand-baskets held by his unicycle-riding figures to block the offensive player's progress while also staying out of the way of the swinging hand-basket his opponent is using in his own defensive strategy. The offensive player can pass the ball from hand-basket to hand-basket while it is being carried toward the goal. When the timer runs out, whether or not the offensive player has scored, it is the other player's turn. Play continues in a similar fashion and when all turns are over, the player with the highest score is declared the winner of the game. If the game is tied, they play an exclusive tiebreaker game. The player who scores first wins, if his opponent doesn't score on his/her turn.

Specifically for the present invention, when making a turn, the rail wheel will turn the swivel bushing that intersects the track line toward the direction the player wants the unicycle-riding figure to go. To move the unicycle backwards, the wheel, the seat and the unicycle-riding figure will turn before the unicycle continues to roll along the tracks, based upon the user input. In FIG. 3, a rotary gear is attached to the base of 39 for rotatably actuating the upper half of the game piece 27 when turning directions on the game board. Also, a bottom hatch 76 is pivotally coupled to basket 48 such that the ball 29 is discharge along a vertical plane when shaft 47 does not rotate.

The defending player can not block his/her opponent's unicycle-riding figures after it passes the Score Base Line. This is penalized by awarding a score to the opponent. The attacking player loses his turn if his/her unicycle-riding figure hits any of his opponent's unicycle-riding figures. The attacking player gets a double turn if his/her opponent's unicycle-riding figure hits his/her unicycle-riding figure.

Unicycles have been known for many decades, but due to their difficult handling they have never become a popular transport. These one-wheeled vehicles are in principle unstable, in both longitudinal and traverse directions. The new device resolves the problems of stability or balance, and can be used as a real transport of goods, persons or materials.

Now the improvements made on the unicycle with the present invention will make unicycles more useable. This innovative means of transport for goods and persons on one-wheel vehicle uses rail-unicycle tracks. A rail wheel will fit onto and rolls along the track line with a secure support attached to the frame that locks it up into the track and is provided with the vehicle. Using the system, the transport of goods, persons, materials or other objects on a single wheel is possible, and thus unicycles can be used not only for entertainment, but also as a commercial vehicle.

This is a vehicle includes a rail wheel (a rim without tire) equipped with a saddle like seat, a frame, a wheel chain (drive chain), connected to the rail wheel. The frame is joined at the end by two track guides for support which provides the stability to stand on the rail-unicycle track. The seat is placed on top of a swivel bushing that allows it to turn easily in any direction. The rail wheel is located between the frame and the track guides, and fits onto the rail-unicycle track. This new unicycle can be used as a motorized unicycle or as a regular unicycle. As a motorized unicycle, it can be maneuvered by a remote controller that moves it along the rail-unicycle tracks, or it can also be maneuvered by the riders themselves if an electronic controller system is incorporated directly into the unicycle. As a regular unicycle, the rail wheel is propelled by the feet of the rider or may be also activated by an electronic device that pedals for the rider. Either way, the rail wheel spins and the unicycle moves along the rail-unicycle tracks.

An alternative version is a video game on DVD. Players have hundreds of levels of play where they can improve their mastery skills by challenging themselves or their opponents.

In an alternate embodiment, robots are employed. It is a 30 foot by 24 foot floorboard, but the playing field is 28 feet by 22 feet with track lines intersecting in the same way as in the tabletop version. The floorboard has an extension containing three seats at each side. Players get in and sit down to operate the unicycles. Each team has three players and each player operates a unicycle. The game play is the same as the tabletop game, but the operating system of the unicycle changes and is as follows:

Each player's seat has two foot pedals: the right pedal moves the unicycle around the board, the left pedal stops the unicycle. There is a "dashboard" in front of the players which has two analog sticks (joysticks), three activation buttons, and a screen showing the play action of the game via cameras.

The right analog stick has a button on top to drop a ball into the goal's cup to score, or to drop a ball into the hand-basket to make passes. The left analog stick has two buttons on top: the right button to raise, and the left button to lower the hand basket.

The unicycle's figures (the robots) are about the size of a six year old child, as an example. Each team has its own colors. The game requires a referee to make sure the game rules are strictly applied.

Another alternative embodiment is racing unicycles. It is a racing contest on a tight closed course over tracks that include steep hills and sharp turns. The racing is organized in two ways; pedaling unicycles, which are unicycles without engines, and motorized unicycles, which are activated by engines.

Another alternative embodiment is real people using live action players. This game is an exciting test of dexterity between two teams of five players each. It involves either pedaling non-motorized unicycles or driving motorized unicycles while passing balls from hand-basket to hand-basket among teammates and dropping balls into opponents' goal cup to score on a large court floor. People who are ready for a challenging and competitive sport will enjoy this exciting game. The game is played on an adjustable floorboard court with track lines intersecting on the surface of the court, and can be fitted on any basketball or tennis court.

Another alternate embodiment is track lines service. A long term project, this transportation service can be provided by the US Government to facilitate another way to go quickly from city to city, or cities to States. The motorized unicycles roll on a series of parallel track lines, protected from the weather by a covering which shelters the entire track. Multiple stations make it accessible to passengers throughout the route. This service can be a solution to the paralyzing effects that inclement weather now has on the commuter work force. It can be a vast source of income for United States, and very accessible and useful for all categories of wage earners.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An electronic table top board game for providing user enjoyment, said board game comprising:

a game board having a plurality of grooves aligned parallel to X and Y axes respectively, said grooves defining travel paths along pre-determined directions covering a major surface area of said game board, said game board further having a plurality of linearly shaped notches formed along end regions oppositely spaced from each other and located along an outer periphery of said game board respectively;

a plurality of controls operably coupled to said game board;

a plurality of mobile game pieces selectively positional along said grooves;

a plurality of target zones anchored to said game board and spaced along said grooves;

a plurality of projectiles associated with each of said game pieces, said projectiles being stored within said notches;

means for independently displacing each of said game pieces along said grooves based upon a user input triggered through an associated one of said controllers; and means for pivotally rotating one arm of each said game pieces such that each player tosses one of said projectiles along a travel path terminating at one of said target zones while a remaining portion of said game pieces remains engaged with said game board.

2. The board game of claim 1, wherein said game piece displacing means comprises:

a processor;

a memory electrically coupled to said processor, said memory including software instructions that cause each of said game pieces to be responsive to said user input, said software instructions including and executing a control logic algorithm including the steps of a. determining whether a first one of said controls has been engaged by an associated one of the players, b. determining a direction in which said first control has been adapted, c. determining a magnitude in which said first control has been adapted, and d. generating a first output signal for instructing said game pieces to travel along said grooves based upon the determined direction and magnitude of said first control adaptation.

3. The board game of claim 1, wherein said arm pivoting means comprises:

software instructions residing on said memory that cause said arm to pivot along a first arcuate path and simultaneously rotate about a fulcrum axis defined along said arcuate path, said software instructions including and executing a control logic algorithm including the steps of a. determining whether a second one of said controls has been engaged by an associated one of the players, b. determining a direction in which said second control has been adapted, c. determining a radius in which said second control has been adapted, and d. generating a second output signal for instructing said arm to pivot along an arcuate path and rotate about the fulcrum axis based upon the direction and magnitude of said second control adaptation.

4. The board game of claim 1, wherein each of said game pieces further comprises:

a plurality of conductive leads in electrical communication with said grooves; and first and second switches directly coupled to said leads and said processor respectively;

wherein said first and second output signals instruct said first and second switches to independently toggle between open and closed positions such that each of said game pieces simultaneously receive said first and second output signals from each of said controllers based upon the user input.

5. The board game of claim 4, wherein said game piece displacing means further comprises:

a motor housed within each of said game pieces; and a drive shaft directly mated to said motor and extending downwardly wherein said drive shaft terminates subjacent to an associated wheel of each of said game pieces such that said drive shaft is in operating and direct communication with said conductive leads while said wheel remains spaced above said grooves;

wherein said motor rotates said drive shaft about a vertically registered fulcrum axis defined along a longitudinal length of said drive shaft such that said conductive leads are caused to rotate in sync and travel along orthogonal directions defined along said grooves.

6. The board game of claim 5, wherein said arm pivoting means further comprises:

first and second beveled gears directly connected to each other, said first beveled gear being directly anchored to a top end of said drive shaft and further being rotatable in sync therewith;

a driven motor electrically coupled to one of said first and second switches;

a rectilinear shaft protruding outwardly from each of said game pieces and having a basket directly attached to a distal end thereof, said basket holding one of said projectiles therein during operating conditions; and an arcuately shaped pivot arm having opposed ends pivotally anchored to said driven motor and a proximal end of said shaft respectively;

wherein said pivot arm rotates along a second arcuate path having a radius smaller than a radius of said first arcuate path such that said rectilinear arm rotates in sync therewith;

wherein said first beveled gear is driven by said drive shaft along a horizontal plane and thereby causes said second beveled gear to rotate along a vertical plane in such a manner that said rectilinear arm simultaneously rotates and pivots based upon the user input.

7. An electronic table top board game for providing user enjoyment, said board game comprising:

a game board having a plurality of grooves aligned parallel to X and Y axes respectively, said grooves defining travel paths along pre-determined directions covering a major surface area of said game board, said game board further having a plurality of linearly shaped notches formed along end regions oppositely spaced from each other and located along an outer periphery of said game board respectively;

a plurality of controls operably coupled to said game board;

a plurality of mobile game pieces selectively positional along said grooves;

a plurality of target zones anchored to said game board and spaced along said grooves;

a plurality of projectiles associated with each of said game pieces, said projectiles being stored within said notches;

means for independently displacing each of said game pieces along said grooves based upon a user input triggered through an associated one of said controllers, wherein said game piece displacing means maintains direct contact with a bottom surface of said grooves during playing conditions; and means for pivotally rotating one arm of each said game pieces such that each player tosses one of said projectiles along a travel path terminating at one of said target zones while a remaining portion of said game pieces remains engaged with said game board.

8. The board game of claim 7, wherein said game piece displacing means comprises:

a processor;

a memory electrically coupled to said processor, said memory including software instructions that cause each of said game pieces to be responsive to said user input, said software instructions including and executing a control logic algorithm including the steps of a. determining whether a first one of said controls has been engaged by an associated one of the players, b. determining a direction in which said first control has been adapted, c. determining a magnitude in which said first control has been adapted, and d. generating a first output signal for instructing said game pieces to travel along said grooves based upon the determined direction and magnitude of said first control adaptation.

9. The board game of claim 7, wherein said arm pivoting means comprises:

software instructions residing on said memory that cause said arm to pivot along a first arcuate path and simultaneously rotate about a fulcrum axis defined along said arcuate path, said software instructions including and executing a control logic algorithm including the steps of a. determining whether a second one of said controls has been engaged by an associated one of the players, b. determining a direction in which said second control has been adapted, c. determining a radius in which said second control has been adapted, and d. generating a second output signal for instructing said arm to pivot along an arcuate path and rotate about the fulcrum axis based upon the direction and magnitude of said second control adaptation.

10. The board game of claim 7, wherein each of said game pieces further comprises:

a plurality of conductive leads in electrical communication with said grooves; and first and second switches directly coupled to said leads and said processor respectively;

wherein said first and second output signals instruct said first and second switches to independently toggle between open and closed positions such that each of said game pieces simultaneously receive said first and second output signals from each of said controllers based upon the user input.

11. The board game of claim 10, wherein said game piece displacing means further comprises:

a motor housed within each of said game pieces; and a drive shaft directly mated to said motor and extending downwardly wherein said drive shaft terminates subjacent to an associated wheel of each of said game pieces such that said drive shaft is in operating and direct communication with said conductive leads while said wheel remains spaced above said grooves;

wherein said motor rotates said drive shaft about a vertically registered fulcrum axis defined along a longitudinal length of said drive shaft such that said conductive leads are caused to rotate in sync and travel along orthogonal directions defined along said grooves.

12. The board game of claim 11, wherein said arm pivoting means further comprises:

first and second beveled gears directly connected to each other, said first beveled gear being directly anchored to a top end of said drive shaft and further being rotatable in sync therewith;

a driven motor electrically coupled to one of said first and second switches;

a rectilinear shaft protruding outwardly from each of said game pieces and having a basket directly attached to a distal end thereof, said basket holding one of said projectiles therein during operating conditions; and an arcuately shaped pivot arm having opposed ends pivotally anchored to said driven motor and a proximal end of said shaft respectively;

wherein said pivot arm rotates along a second arcuate path having a radius smaller than a radius of said first arcuate path such that said rectilinear arm rotates in sync therewith;

wherein said first beveled gear is driven by said drive shaft along a horizontal plane and thereby causes said second beveled gear to rotate along a vertical plane in such a manner that said rectilinear arm simultaneously rotates and pivots based upon the user input.

13. An electronic table top board game for providing user enjoyment, said board game comprising:

a game board having a plurality of grooves aligned parallel to X and Y axes respectively, said grooves defining travel paths along pre-determined directions covering a major surface area of said game board, said game board further having a plurality of linearly shaped notches formed along end regions oppositely spaced from each other and located along an outer periphery of said game board respectively;

a plurality of controls operably coupled to said game board;

a plurality of mobile game pieces selectively positional along said grooves;

a plurality of target zones anchored to said game board and spaced along said grooves, wherein said target zones are manually and removably attached to said game board;

a plurality of projectiles associated with each of said game pieces, said projectiles being stored within said notches;

means for independently displacing each of said game pieces along said grooves based upon a user input triggered through an associated one of said controllers, wherein said game piece displacing means maintains direct contact with a bottom surface of said grooves during playing conditions; and means for pivotally rotating one arm of each said game pieces such that each player tosses one of said projectiles along a travel path terminating at one of said target zones while a remaining portion of said game pieces remains engaged with said game board.

14. The board game of claim 13, wherein said game piece displacing means comprises:

a processor;

a memory electrically coupled to said processor, said memory including software instructions that cause each of said game pieces to be responsive to said user input, said software instructions including and executing a control logic algorithm including the steps of a. determining whether a first one of said controls has been engaged by an associated one of the players, b. determining a direction in which said first control has been adapted, c. determining a magnitude in which said first control has been adapted, and d. generating a first output signal for instructing said game pieces to travel along said grooves based upon the determined direction and magnitude of said first control adaptation.

15. The board game of claim 13, wherein said arm pivoting means comprises:

software instructions residing on said memory that cause said arm to pivot along a first arcuate path and simultaneously rotate about a fulcrum axis defined along said arcuate path, said software instructions including and executing a control logic algorithm including the steps of a. determining whether a second one of said controls has been engaged by an associated one of the players, b. determining a direction in which said second control has been adapted, c. determining a radius in which said second control has been adapted, and d. generating a second output signal for instructing said arm to pivot along an arcuate path and rotate about the fulcrum axis based upon the direction and magnitude of said second control adaptation.

16. The board game of claim 13, wherein each of said game pieces further comprises:

a plurality of conductive leads in electrical communication with said grooves; and first and second switches directly coupled to said leads and said processor respectively;

wherein said first and second output signals instruct said first and second switches to independently toggle between open and closed positions such that each of said game pieces simultaneously receive said first and second output signals from each of said controllers based upon the user input.

17. The board game of claim 16, wherein said game piece displacing means further comprises:

a motor housed within each of said game pieces; and a drive shaft directly mated to said motor and extending downwardly wherein said drive shaft terminates subjacent to an associated wheel of each of said game pieces such that said drive shaft is in operating and direct communication with said conductive leads while said wheel remains spaced above said grooves;

wherein said motor rotates said drive shaft about a vertically registered fulcrum axis defined along a longitudinal length of said drive shaft such that said conductive leads are caused to rotate in sync and travel along orthogonal directions defined along said grooves.

18. The board game of claim 17, wherein said arm pivoting means further comprises:

first and second beveled gears directly connected to each other, said first beveled gear being directly anchored to a top end of said drive shaft and further being rotatable in sync therewith;

a driven motor electrically coupled to one of said first and second switches;

a rectilinear shaft protruding outwardly from each of said game pieces and having a basket directly attached to a distal end thereof, said basket holding one of said projectiles therein during operating conditions; and an arcuately shaped pivot arm having opposed ends pivotally anchored to said driven motor and a proximal end of said shaft respectively;

wherein said pivot arm rotates along a second arcuate path having a radius smaller than a radius of said first arcuate path such that said rectilinear arm rotates in sync therewith;

wherein said first beveled gear is driven by said drive shaft along a horizontal plane and thereby causes said second beveled gear to rotate along a vertical plane in such a manner that said rectilinear arm simultaneously rotates and pivots based upon the user input.

* * * * *